US005931592A

United States Patent [19]

Timberlake

[11] Patent Number: 5,931,592

[45] Date of Patent: Aug. 3, 1999

[54] CHALK HOLDING DEVICE

[76] Inventor: Ronald E. Timberlake, 272 Farallones St., San Francisco, Calif. 94112

[21] Appl. No.: 09/097,961

[22] Filed: Jun. 16, 1998

[51] Int. Cl.[6] ..... B43K 23/016; B43K 21/22

[52] U.S. Cl. ..... 401/88; 401/82; 401/87; 401/93

[58] Field of Search ..... 401/88, 92, 93, 401/140, 87, 82

[56] References Cited

U.S. PATENT DOCUMENTS

| | | | |
|---|---|---|---|
| 1,291,671 | 1/1919 | Roll | 401/92 |
| 2,687,116 | 8/1954 | Sheets | 401/93 |
| 3,788,753 | 1/1974 | Stewart | 401/140 X |
| 5,213,432 | 5/1993 | Chapell | 401/140 X |

FOREIGN PATENT DOCUMENTS

| | | | |
|---|---|---|---|
| 658528 | 10/1951 | United Kingdom | 401/140 |

*Primary Examiner*—Steven A. Bratlie

[57] ABSTRACT

A new chalk holding device for marking a tire of a vehicle. The inventive device includes an elongate shaft having an upper straight portion and a lower arcuate portion which curves away from the longitudinal axis of the straight portion such that the lower end of the shaft is extended at obtuse angle from the longitudinal axis of the straight portion. The lower end of said shaft has an attachment device for attaching a stick of chalk to the lower end of the shaft. An elongate handle rod is extended through the straight portion such that the ends of the handle rod outwardly extend away from the straight portion.

11 Claims, 2 Drawing Sheets

CHALK HOLDING DEVICE

BACKGROUND OF THE INVENTION

1. Field of the Invention

The present invention relates to chalk holding devices and more particularly pertains to a new chalk holding device for marking a tire of a vehicle.

2. Description of the Prior Art

The use of chalk holding devices is known in the prior art. More specifically, chalk holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art chalk holding devices include U.S. Pat. No. 4,892,251; U.S. Pat. No. 4,890,944; U.S. Pat. No. Des. 332,157; U.S. Pat. No. 5,423,584; U.S. Pat. No. 5,188,409; and U.S. Pat. No. 4,298,036.

While these devices fulfill their respective, particular objectives and requirements, the aforementioned patents do not disclose a new chalk holding device. The inventive device includes an elongate shaft having an upper straight portion and a lower arcuate portion which curves away from the longitudinal axis of the straight portion such that the lower end of the shaft is extended at obtuse angle from the longitudinal axis of the straight portion. The lower end of said shaft has an attachment device for attaching a stick of chalk to the lower end of the shaft. An elongate handle rod is extended through the straight portion such that the ends of the handle rod outwardly extend away from the straight portion.

In these respects, the chalk holding device according to the present invention substantially departs from the conventional concepts and designs of the prior art, and in so doing provides an apparatus primarily developed for the purpose of marking a tire of a vehicle.

SUMMARY OF THE INVENTION

In view of the foregoing disadvantages inherent in the known types of chalk holding devices now present in the prior art, the present invention provides a new chalk holding device construction wherein the same can be utilized for marking a tire of a vehicle.

The general purpose of the present invention, which will be described subsequently in greater detail, is to provide a new chalk holding device apparatus and method which has many of the advantages of the chalk holding devices mentioned heretofore and many novel features that result in a new chalk holding device which is not anticipated, rendered obvious, suggested, or even implied by any of the prior art chalk holding devices, either alone or in any combination thereof.

To attain this, the present invention generally comprises an elongate shaft having an upper straight portion and a lower arcuate portion which curves away from the longitudinal axis of the straight portion such that the lower end of the shaft is extended at obtuse angle from the longitudinal axis of the straight portion. The lower end of said shaft has an attachment device for attaching a stick of chalk to the lower end of the shaft. An elongate handle rod is extended through the straight portion such that the ends of the handle rod outwardly extend away from the straight portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new chalk holding device apparatus and method which has many of the advantages of the chalk holding devices mentioned heretofore and many novel features that result in a new chalk holding device which is not anticipated, rendered obvious, suggested, or even implied by any of the prior art chalk holding devices, either alone or in any combination thereof.

It is another object of the present invention to provide a new chalk holding device which may be easily and efficiently manufactured and marketed.

It is a further object of the present invention to provide a new chalk holding device which is of a durable and reliable construction.

An even further object of the present invention is to provide a new chalk holding device which is susceptible of a low cost of manufacture with regard to both materials and labor, and which accordingly is then susceptible of low prices of sale to the consuming public, thereby making such chalk holding device economically available to the buying public.

Still yet another object of the present invention is to provide a new chalk holding device which provides in the apparatuses and methods of the prior art some of the advantages thereof, while simultaneously overcoming some of the disadvantages normally associated therewith.

Still another object of the present invention is to provide a new chalk holding device for marking a tire of a vehicle.

Yet another object of the present invention is to provide a new chalk holding device which includes an elongate shaft having an upper straight portion and a lower arcuate portion which curves away from the longitudinal axis of the straight portion such that the lower end of the shaft is extended at obtuse angle from the longitudinal axis of the straight portion. The lower end of said shaft has an attachment device for attaching a stick of chalk to the lower end of the shaft. An elongate handle rod is extended through the straight portion such that the ends of the handle rod outwardly extend away from the straight portion.

Still yet another object of the present invention is to provide a new chalk holding device that allows a user to mark a tire using a stirring motion rather than having to bend their wrist when marking a tire with chalk. This allows users with limited hand and wrist motion to be able to easily mark tires with chalk.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
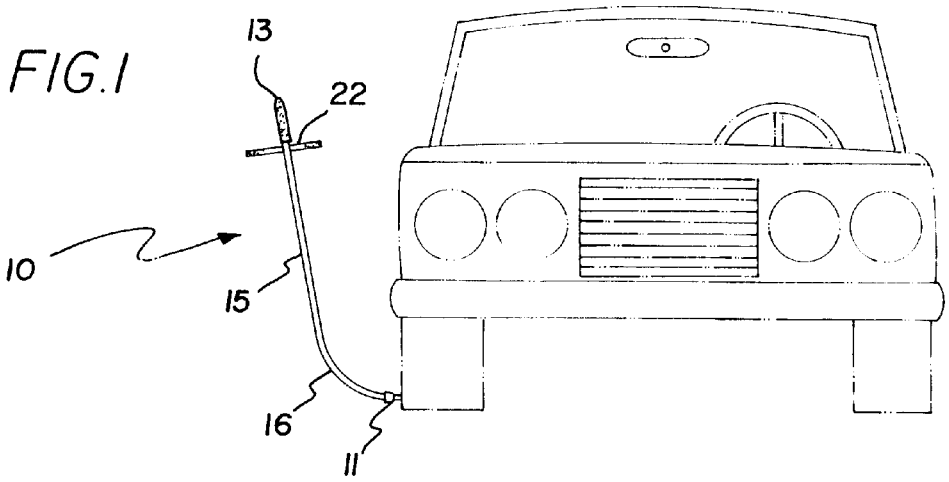
FIG. 1 is a schematic side view of a new chalk holding device in use marking a tire of a vehicle according to the present invention.

With reference now to the drawings, and in particular to FIGS. 1 through 4 thereof, a new chalk holding device embodying the principles and concepts of the present invention and generally designated by the reference numeral 10 will be described.

As best illustrated in FIGS. 1 through 4, the chalk holding device 10 generally comprises an elongate shaft 12 having an upper straight portion 15 and a lower arcuate portion 16 which curves away from the longitudinal axis of the straight portion 15 such that the lower end 14 of the shaft 12 is extended at obtuse angle from the longitudinal axis of the straight portion 15. The lower end 14 of said shaft 12 has an attachment device 17 for attaching a stick of chalk 11 to the lower end 14 of the shaft 12. An elongate handle rod 22 is extended through the straight portion 15 such that the ends of the handle rod 22 outwardly extend away from the straight portion 15.

In use, the chalk holding device 10 is designed for holding a stick of chalk 11 for marking a tire of a vehicle using a simple stirring motion with the arm without the user having to bend their wrist. In closer detail, the elongate shaft 12 is ideally generally cylindrical and has upper and lower ends 13,14, a straight portion 15 and an arcuate portion 16. The straight portion 15 is located adjacent the upper end 13 of the shaft 12. The arcuate portion 16 is located adjacent the lower end 14 of the shaft 12 and curves away from the longitudinal axis of the straight portion 15 such that the lower end 14 of the shaft 12 is extended at obtuse angle from the longitudinal axis of the straight portion 15. Ideally, the obtuse angle is between about 135 degrees and about 150 degrees (that is, between about 30 and 45 degrees when measuring the complementary acute angle formed between the lower end 14 of the shaft 12 and the longitudinal axis of the straight portion 15). In an ideal illustrative embodiment, the shaft 12 has a thickness of about ½ inch and the straight portion 15 has a length greater than about 2 feet and ideally, about 3 feet.

The lower end 14 of the shaft 12 has an attachment device 17 for attaching a stick of chalk 11 to the lower end 14 of the shaft 12.

Figure 3:
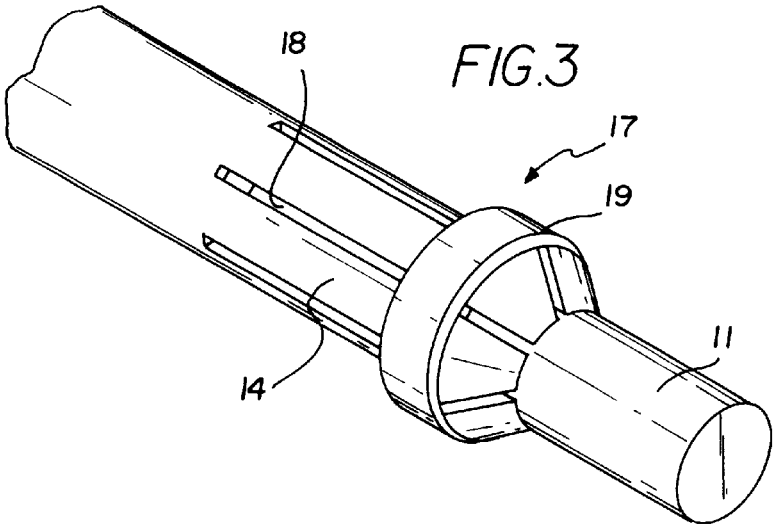
FIG. 3 is a schematic perspective view of the lower end of the present invention illustrating one preferred attachment device.
Figure 4:
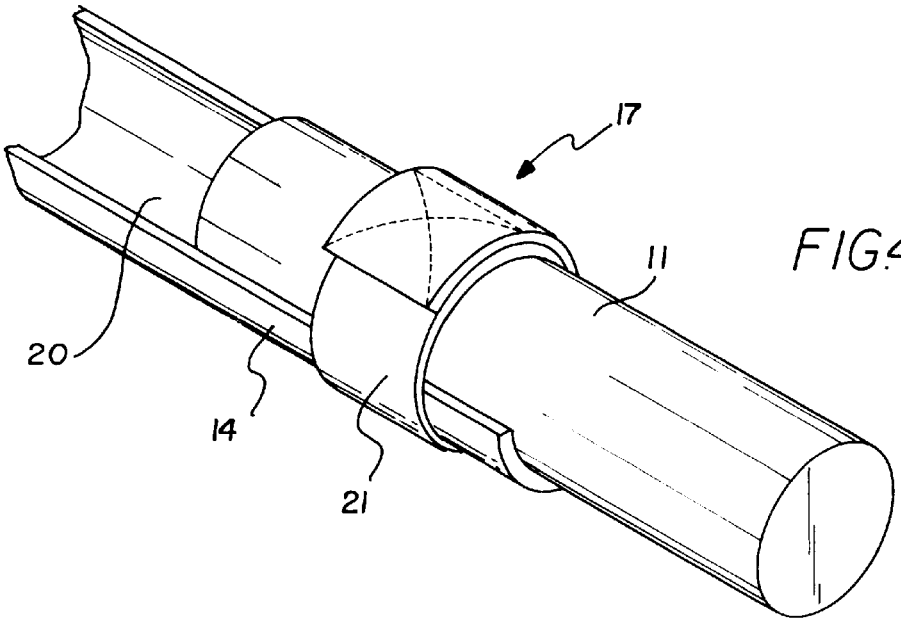
FIG. 4 is a schematic perspective view of the lower end of the present invention illustrating another preferred attachment device.

As illustrated in FIG. 3, in one preferred embodiment, the lower end 14 of the shaft 12 has a castrated bore 18 having a plurality of elongated slots into the bore 18. The bore 18 is adapted for receiving a stick of chalk 11. A collet ring 19 is disposed around the lower end 14 of the shaft 12 adjacent the bore 18 such that collet ring 19 holds a stick of chalk 11 in the bore 18 of the lower end 14 of the shaft 12. With reference to FIG. 4, in another preferred embodiment, the lower end 14 of the shaft 12 has a groove 20 adapted for receiving a stick of chalk 11 therein with an elongate strap 21 wrapped around the lower end 14 of the shaft 12 adjacent the groove 20 of the lower end 14 of the shaft 12 to hold the stick of chalk 11 received by the groove 20 of the lower end 14 of the shaft 12. Ideally, a hook and loop fastener detachably attaches the ends of the strap 21 together when the strap 21 is looped around the lower end 14 of the shaft 12.

Figure 2:
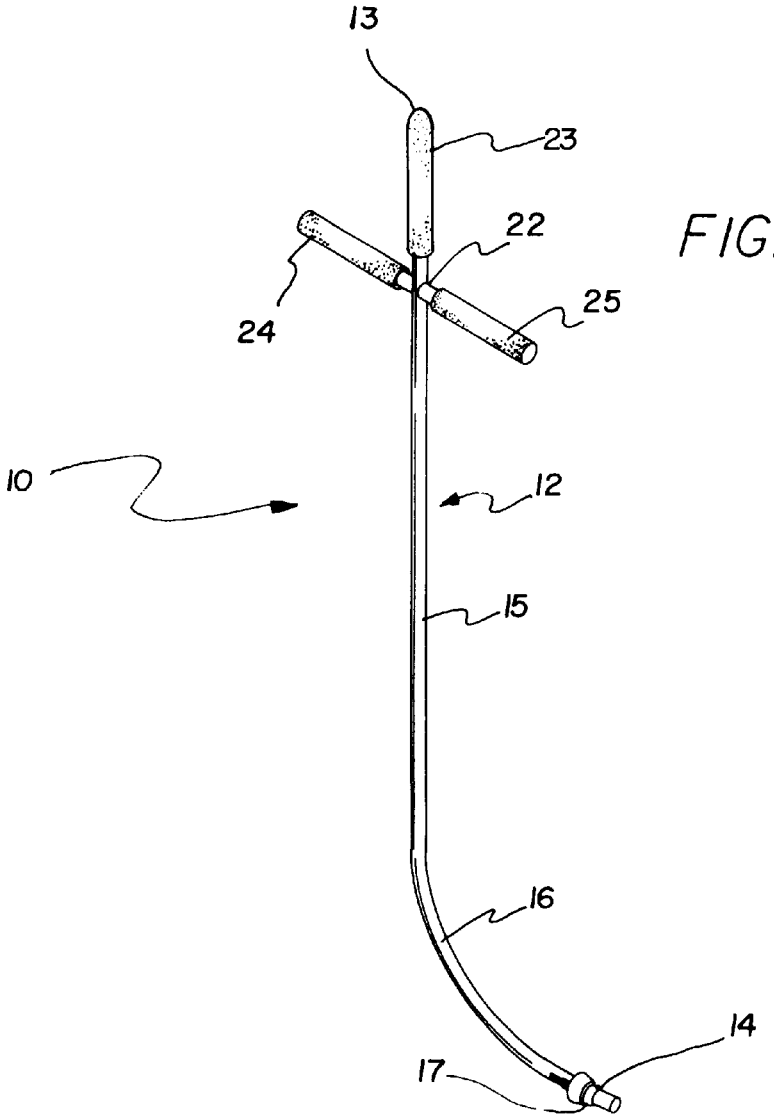
FIG. 2 is a schematic perspective view of the present invention.

As illustrated in FIG. 2, the elongate handle rod 22 is extended through the straight portion 15 such that the ends of the handle rod 22 outwardly extend away from the straight portion 15. The handle rod 22 is positioned towards the upper end 13 of the shaft 12 such that the handle rod 22 is spaced apart from the upper end 13 of the shaft 12 so that three handles are formed by the handle rod 22 and portion of the straight portion 15 between the handle rod 22 and the upper end 13 of the shaft 12. Preferably, the longitudinal axis of the handle rod 22 is extended substantially perpendicular to the longitudinal axis of the straight portion 15.

Preferably, the handle rod 22 has a length greater than about 5 inches. Ideally, the length of the handle rod 22 is about 7 inches. Also preferably, the handle rod 22 is spaced apart from the upper end 13 of the shaft 12 at least about 4 inches. Ideally, the handle rod 22 is spaced apart from the upper end 13 of the shaft 12 about 6 inches.

Preferably, a plurality of hand grips 23,24,25 are also provided. A first 23 of the hand grips receives therein the upper end 13 of the shaft 12, a second 24 of the hand grips 24 receives therein one of the ends of the handle rod 22, and a third of the hand grips 25 receives therein another of the ends of the handle rod 22. The hand grips 23,24,25 are designed for aiding the grip of a user holding on to the upper end 13 of the shaft 12 and the ends of the handle rod 22. Ideally, the hand grips 23,24,25 comprise a resiliently compressible material such as rubber or foamed rubber.

In use, a user uses the device 10 to mark a tire of a vehicle with a mark from a stick of chalk attached to the lower end of the shaft as illustrated in FIG. 1. The user holds the shaft at one of the handgrips in a manner similar to holding a whisk or spoon when stirring. By making a stirring motion with the arm, the user is then able to easily and quickly make a mark on the tire of the vehicle without bending their wrist.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for holding a stick of chalk for marking a tire of a vehicle, said device comprising:

an elongate shaft having upper and lower ends, a straight portion and an arcuate portion having a predetermined radius of curvature extending entirely to said lower end;

said straight portion being located adjacent said upper end of said shaft;

said straight portion having a longitudinal axis;

said arcuate portion being located adjacent said lower end of said shaft;

said arcuate portion continuously curving away from said longitudinal axis of said straight portion such that said lower end of said shaft is extended at obtuse angle from said longitudinal axis of said straight portion;

attachment means for attaching a stick of chalk to said lower end of said shaft;

an elongate handle rod having a pair of opposite ends and a longitudinal axis; and said handle rod being extended through said straight portion such that said ends of said handle rod outwardly extend away from said straight portion in perpendicular relationship therewith such that said handle rod is spaced apart from said upper end of said shaft so that three handles are formed by said handle rod and a part of said straight portion of said shaft between said handle rod and said upper end of the shaft, wherein the three handles are each substantially linear and have substantially equal lengths.

2. The device of claim 1, wherein said shaft has a thickness, said thickness being about ½ inch.

3. The device of claim 1, wherein said straight portion has a length, said length of said straight portion being greater than about 2 feet.

4. The device of claim 1, wherein said obtuse angle is between about 135 degrees and about 150 degrees.

5. The device of claim 1, wherein said handle rod is spaced apart from said upper end of said shaft at least about 4 inches.

6. The device of claim 1, wherein said handle rod has a length greater than about 5 inches.

7. The device of claim 1, further comprising a plurality of hand grips, a first of said hand grips receiving therein said upper end of said shaft, a second of said hand grips receiving therein one of said ends of said handle rod, a third of said hand grips receiving therein another of said ends of said handle rod.

8. The device of claim 7, wherein said hand grips comprise a resiliently compressible material.

9. A device for holding a stick of chalk as set forth in claim 1 wherein said lower end of said shaft has a bore having a plurality of elongated slots into said bore, said bore being adapted for receiving a stick of chalk, wherein said attachment means comprises a ring disposed around said lower end of said shaft adjacent said bore such that said ring holds a stick of chalk in said bore of said lower end of said shaft.

10. A device for holding a stick of chalk as set forth in claim 1 wherein said lower end of said shaft has a groove for defining an open upper face and a lower face with a substantially U-shaped cross-section on said lower end of said shaft which is adapted for receiving a stick of chalk therein, wherein said attachment means comprises an elongate strap wrapped around said lower end of said shaft to hold the stick of chalk received by said groove of said lower end of said shaft, wherein a hook and loop fastener detachably attaches ends of said strap together when said strap is looped around said lower end of said shaft.

11. A device for holding a stick of chalk for marking a tire of a vehicle, said device comprising:

an elongate shaft having upper and lower ends, an upper linear straight portion and a lower arcuate portion having a predetermined radius of curvature extending entirely to said lower end, wherein said shaft has a circular cross-section along a length thereof;

said shaft having a thickness, said thickness being about ½ inch;

said straight portion being located adjacent said upper end of said shaft;

said straight portion having a longitudinal axis;

said straight portion having a length, wherein said length of said straight portion is about 3 feet;

said arcuate portion being located adjacent said lower end of said shaft;

said arcuate portion continuously curving away from said longitudinal axis of said straight portion such that said lower end of said shaft is extended at obtuse angle from said longitudinal axis of said straight portion;

wherein said obtuse angle is between about 135 degrees and about 150 degrees;

attachment means for attaching a stick of chalk to said lower end of said shaft;

wherein said lower end of said shaft has a groove for defining an open upper face and a lower face with a substantially U-shaped cross-section on said lower end of said shaft which is adapted for receiving a stick of chalk therein, wherein said attachment means comprises an elongate strap wrapped around said lower end of said shaft to hold the stick of chalk received by said groove of said lower end of said shaft, wherein a hook and loop fastener detachably attaches ends of said strap together when said strap is looped around said lower end of said shaft;

an elongate handle rod having a pair of opposite ends and a longitudinal axis;

said handle rod being extended through said straight portion such that said ends of said handle rod outwardly extend away from said straight portion;

said handle rod being positioned towards said upper end of said shaft such that said handle rod is spaced apart from said upper end of said shaft so that three handles are formed by said handle rod and a portion of said straight portion of said shaft between said handle rod and said upper end of said shaft;

wherein the three handles are each substantially linear and have substantially equal lengths;

said handle rod having a length of about 7 inches;

said handle rod being spaced apart from said upper end of said shaft about 6 inches;

said longitudinal axis of said handle rod being extended substantially perpendicular to said longitudinal axis of said straight portion;

a plurality of hand grips, a first of said hand grips receiving therein said upper end of said shaft, a second of said hand grips receiving therein one of said ends of said handle rod, a third of said hand grips receiving therein another of said ends of said handle rod; and said hand grips being for aiding the grip of a user holding on to said upper end of the shaft and ends of said handle rod, wherein said hand grips comprise a resiliently compressible material including rubber.

* * * * *